US010391662B2

(12) United States Patent
Dénisse et al.

(10) Patent No.: US 10,391,662 B2
(45) Date of Patent: Aug. 27, 2019

(54) ADJUSTABLE CONVERTING ARRANGEMENT FOR A FLAT SUBSTRATE, CASSETTE, UNIT AND MACHINE PROVIDED THEREWITH

(71) Applicant: BOBST MEX SA, Mex (CH)

(72) Inventors: Guillaume Dénisse, Féternes (FR); Christophe Kuhn, Sauverny (FR)

(73) Assignee: BOBST MEX SA (CH)

( * ) Notice: Subject to any disclaimer, the term of this patent is extended or adjusted under 35 U.S.C. 154(b) by 560 days.

(21) Appl. No.: 14/770,872

(22) PCT Filed: Mar. 4, 2014

(86) PCT No.: PCT/EP2014/000544
§ 371 (c)(1),
(2) Date: Aug. 27, 2015

(87) PCT Pub. No.: WO2014/135265
PCT Pub. Date: Sep. 12, 2014

(65) Prior Publication Data

US 2016/0008998 A1 Jan. 14, 2016

(30) Foreign Application Priority Data

Mar. 7, 2013 (EP) ..... 13001150

(51) Int. Cl.
*B26D 7/26* (2006.01)
*B26F 1/38* (2006.01)
(Continued)

(52) U.S. Cl.
CPC ..... *B26D 7/265* (2013.01); *B26D 7/1818* (2013.01); *B26F 1/384* (2013.01); *B31F 1/07* (2013.01);
(Continued)

(58) Field of Classification Search
CPC ..... B26D 7/265; B26D 7/1818; B26F 1/384; B31F 1/07; B31F 1/10; B31F 2201/0753;
(Continued)

(56) References Cited

U.S. PATENT DOCUMENTS 558,496 A * 4/1896 Wittkopf ..... A47B 23/004 84/506
3,418,925 A * 12/1968 Wiggins ..... B31F 1/07 100/176
(Continued)

FOREIGN PATENT DOCUMENTS

| | | |
|---|---|---|
| EP | 0 764 505 A1 | 3/1997 |
| EP | 1 531 975 | 5/2005 |
| FR | 2 452 372 | 10/1980 |

OTHER PUBLICATIONS

International Search Report dated Jul. 23, 2014 in corresponding PCT International Application No. PCT/EP2014/000544.

*Primary Examiner* — Sameh Tawfik
(74) *Attorney, Agent, or Firm* — Ostrolenk Faber LLP

(57) ABSTRACT

An arrangement for transforming a planar support (2) includes first and second rotating cylindrical transformation tools (16, 17), cooperating to convert the support (2), first and second side bearings (26, 27), holding the first tool (16) for rotation (Rs), third and fourth side bearings (29, 31), holding the second tool (17) for rotation (Ri), spacers (43, 44, 46, 47) having an inclined face (48) and slidable (S) to adjust the respective distances (e, e1, e2) between the first and third bearings (26, 29) and between the second and fourth bearings (27, 31), to set a radial gap (20) between the two tools (16, 17). In another solution, either as an alternative to or in cooperation with the first solution, the spacer (43) is moved (S) by a differential screw (57) having a first thread (58) that engages with a tapped hole (59) in an integral part (61) of one of the bearings (29) and a second
(Continued)

thread (62) different than the first thread (58) and engaging with a tapped hole (63) in the spacer (43).

13 Claims, 2 Drawing Sheets

(51) Int. Cl.

| | |
|---|---|
| ***B31F 1/07*** | (2006.01) |
| ***B31F 1/10*** | (2006.01) |
| ***B26D 7/18*** | (2006.01) |
| *B31B 50/16* | (2017.01) |
| *B31B 50/88* | (2017.01) |
| *B31B 50/25* | (2017.01) |
| *B31B 50/00* | (2017.01) |

(52) U.S. Cl.
CPC ..... *B31F 1/10* (2013.01); *B31B 50/005* (2017.08); *B31B 50/16* (2017.08); *B31B 50/256* (2017.08); *B31B 50/88* (2017.08); *B31F 2201/0753* (2013.01); *B31F 2201/0794* (2013.01)

(58) Field of Classification Search
CPC ..... B31F 2201/0794; B31B 50/005; B31B 50/16; B31B 50/256; B31B 50/88
USPC ..... 493/471
See application file for complete search history.

(56) References Cited

U.S. PATENT DOCUMENTS

| | | | | | |
|---|---|---|---|---|---|
| 4,455,903 | A * | 6/1984 | Kesten | B26D 7/20 | 101/24 |
| 4,553,461 | A * | 11/1985 | Belongia | B26D 7/00 | 83/342 |
| 4,732,082 | A * | 3/1988 | Ireton | B21D 17/04 | 101/23 |
| 4,948,269 | A * | 8/1990 | Hamilton | B26D 7/2628 | 384/467 |
| 5,035,037 | A * | 7/1991 | Sprung | B65H 20/20 | 492/4 |
| 5,378,221 | A * | 1/1995 | Lauderbaugh | B26D 7/2635 | 493/354 |
| 5,554,334 | A * | 9/1996 | Kashio | B41C 3/06 | 264/293 |
| 5,582,569 | A * | 12/1996 | Kowalewski | B41F 13/0045 | 493/34 |
| 6,085,626 | A * | 7/2000 | Pfaff, Jr. | B26D 7/2628 | 83/698.51 |
| 6,627,026 | B2 * | 9/2003 | Andersson | B31F 1/10 | 100/176 |
| 2012/0053034 | A1 * | 3/2012 | Diehr | B31B 1/00 | 493/55 |
| 2013/0042771 | A1 * | 2/2013 | Alkhagen | B26D 5/007 | 101/23 |

* cited by examiner

ADJUSTABLE CONVERTING ARRANGEMENT FOR A FLAT SUBSTRATE, CASSETTE, UNIT AND MACHINE PROVIDED THEREWITH

CROSS-REFERENCE TO RELATED APPLICATIONS

The present application is a 35 U.S.C. §§ 371 national phase conversion of PCT/EP2014/000544, filed Mar. 4, 2014, which claims priority of European Application No. 13001150.5, filed Mar. 7, 2013, the contents of which are incorporated by reference herein. The PCT International Application was published in the French language.

The present invention concerns an adjustable converting arrangement for a flat substrate, provided with two cylindrical converting tools, in a machine for producing packaging. The invention also relates to a converting cassette for a flat substrate, comprising an adjustable converting arrangement for the flat substrate. The invention concerns a converting unit for a flat substrate which is provided with a converting cassette for the flat substrate. The invention concerns a converting unit for a flat substrate, comprising at least one adjustable converting arrangement for the flat substrate. The invention also concerns a machine for producing packaging from a flat substrate, comprising a converting unit for the flat substrate.

TECHNICAL BACKGROUND

A machine for producing packaging is intended for the manufacture of boxes which form the packaging, after folding and gluing. In the machine, an initial flat substrate, such as a continuous web of cardboard, is unwound and is printed by a print unit, made up by printing units. The web is then transferred into a converting unit, in order to make plate elements, in this case boxes.

The converting unit comprises at least one converting arrangement provided with two cylindrical rotary tools, positioned parallel to one another and spaced apart with respect to the diameter of the tools, so as to cooperate. The web runs in a gap between the two tools in order to be converted there. Each of the two tools turns in a respective opposite direction. The first tool is rotatably mounted in a first and a second bearing and the second tool is rotatably mounted in a third and a fourth bearing. The first and third and also the second and fourth bearings are spaced apart with respect to the diameter of the tools. Tightening elements are provided in order to maintain the first and the third bearing as well as the second and the fourth bearing firmly together. Most of the time, the converting arrangement is provided so as to form a cassette. The cassette is inserted by sliding it into each of the lateral supporting frames of the unit.

The cassette allows the tools to be changed quickly, in terms of the conversions of the substrate to be realized. The packaging manufacturer has at least two cassettes. A first cassette is in the machine currently operating and has been adapted in terms of the current converting job. During this time, a second cassette may be being assembled and adjusted so as to be adapted for the following converting job. When the job is to be changed, the operator takes out the old cassette and inserts the new cassette, reducing the time the machine is stopped to a minimum.

As a first example, one of the arrangements or one of the cassettes is a rotary cutting arrangement or a rotary cutting cassette respectively. A first cylindrical cutting tool is provided with knives, and a second cylindrical tool is smooth and is called an anvil. At the moment of the cut, the edges of the knives of the cutting tool must pass as close as possible to the anvil cylinder so as to carry out a clean cut. The edges of the knives, however, must not touch the anvil cylinder as they would be irreparably destroyed during rotation. The constituent material of the support, i.e. the fibers in the case of cardboard, must not appear or be visible at the cut. Neither is it desirable to have dust originating from the cut in the constituent material of the support.

This is why the optimum radial gap between the two cylindrical rotary tools is adjusted to a micron degree. So that said gap is obtained in such a precise manner, each end of the two cylindrical rotary tools comprises a bearing ring around a respective tool. The bearing ring at one end of one of the tools rolls on the bearing ring at the same end of the other of the tools (see document EP-0,764,505).

As a second example, one of the arrangements or one of the cassettes is a rotary creasing arrangement or a rotary creasing cassette respectively. A first cylindrical creasing tool is provided with a male creasing form or matrix and a second cylindrical tool is provided with a complementary female creasing form or matrix. The creasing must be clean, with no fractures on the edges or the bottom of the creasing. In this case, the optimum radial gap between the two cylindrical rotary tools is adjusted to the hundredth of a millimeter.

PRIOR ART

In order to obtain a first adjustment of the radial gap, the first and second bearings respectively are pressurized by means of jacks against the third and fourth bearings so as to apply the desired cutting pressure while obtaining the radial gap between the two tools.

Documents FR-2,452,372 and EP-1,531,975 describe an arrangement in which the gap between the four bearings is adjusted with two wedges or spacers with an inclined face and sliding together.

However, such an arrangement does not provide the possibility of adjusting the levels between the first and third bearings and between the second and fourth bearings.

SUMMARY OF THE INVENTION

A main objective of the present invention consists in adjusting a converting arrangement for a flat substrate, intended for a converting unit in a machine producing packaging. A second objective is to realize a converting arrangement with rotary tools which allows a simpler, more sensitive and therefore extremely precise adjustment of the gap between the two tools to be obtained. A third objective is to provide an arrangement which allows the reproducibility of the adjustments between the rotary tools to be improved. A fourth objective is to resolve the technical problems mentioned for the arrangements of the prior art. A fifth objective is to simplify and to facilitate all tools changing in an arrangement, whilst simplifying and optimizing the later adjustments. A sixth objective consists in providing a cassette which comprises a converting arrangement for the converting unit. Yet another objective is that of succeeding in inserting a converting unit into a machine producing the packaging.

A converting arrangement for a flat substrate comprises a first and a second cylindrical rotary converting tool. The first and the second cylindrical rotary converting tools are arranged to cooperate to provide a conversion of the flat substrate. The converting arrangement for the flat substrate comprises a first and a second lateral bearing. The first and the second lateral bearings hold the first cylindrical rotary tool for rotation. The converting arrangement for the flat substrate also comprises a third and a fourth lateral bearing. The third and the fourth lateral bearings hold the second cylindrical rotary tool for rotation. The converting arrangement for the flat substrate comprises adjustment means in the form of spacers, each of which has an inclined face and the spacers may slide together. The respective spacers adjust the gap between the first bearing and the third bearing. The respective spacers also adjust the gap between the second bearing and the fourth bearing. The spacers therefore allow a radial gap between the first cylindrical rotary converting tool and the second cylindrical rotary converting tool to be adjusted.

In accordance with one aspect of the present invention, the converting arrangement for the flat substrate includes adjustment means that comprise two spacers which are inserted between the first lateral bearing and the third lateral bearing and two other spacers which are inserted between the second lateral bearing and the fourth lateral bearing.

In other words, with two adjustable spacers for two bearings, the precision of the adjustment proves to be really superior. The adjustment allows the level of each of the two bearings to be well balanced and regulated on both sides of the arrangement. Such adjustments allow optimum conversion of the flat substrate to be retained all along the production. Four possibilities of adjustment are possible with four spacers. That multiplication of the adjustments also allows the manufacture of the bearings to be simplified.

In accordance with another aspect of the present invention, in the converting arrangement for the flat substrate, the spacer is displaced by means of a differential screw, which has a first outer thread which cooperates with a first inner thread of a part which is joined with one of the lateral bearings, and has a second outer thread which is distinct from the first outer thread which cooperates with a second inside thread of the spacer.

Expressed another way, with such a screw per spacer, the adjustment can be realized with much more precision, in terms of the dimensions of the chosen threads. Such an adjustment allows a high quality conversion of the flat substrate to be obtained and retained throughout the length of the production.

Fine adjustment allows wear on one cylindrical rotary converting tool or on both cylindrical rotary converting tools, which takes place as they are used, to be compensated for in a progressive manner. The lifetime of the tool or tools is increased. Optimized adjustment also makes it possible to have bearings which are simpler to manufacture, requiring less machining precision. Fine, precise adjustment allows the time to adjust the radial gap between the two tools to be reduced.

The flat substrate is defined, for example, as being of a material in a continuous web, such as paper, flat cardboard, corrugated cardboard, glued corrugated cardboard, flexible plastic, for example polyethylene (PE), polyethylene-terephthalate (PET), bioriented polypropylene (BOPP), or yet other materials.

In another aspect of the invention, a converting cassette for a flat substrate comprises a converting arrangement for the flat substrate which has one or several of the technical characteristics described above. The converting cassette makes access, assembly and disassembly of the tools easier for the operator carrying out the adjustments and the maintenance of the unit and of the machine.

According to another aspect of the invention, a converting unit for a flat substrate is provided with at least one converting cassette for the flat substrate, and the cassette is provided with a converting arrangement for the flat substrate, having one or several of the technical characteristics described above.

According to another aspect of the invention, a converting unit for a flat substrate comprises at least one converting arrangement for the flat substrate, having one or several of the technical characteristics described above.

According to yet another aspect of the invention, a machine for producing packaging from a flat substrate comprises at least one converting unit for the flat substrate, having one or several of the technical characteristics described above.

BRIEF DESCRIPTION OF THE DRAWINGS

The invention will be well understood and its diverse advantages and different characteristics will be highlighted better from the following description and from the non-limiting exemplary embodiment, with reference to the accompanying schematic drawings, in which.

DETAILED DESCRIPTION OF THE PREFERRED EMBODIMENTS

Figure 1:
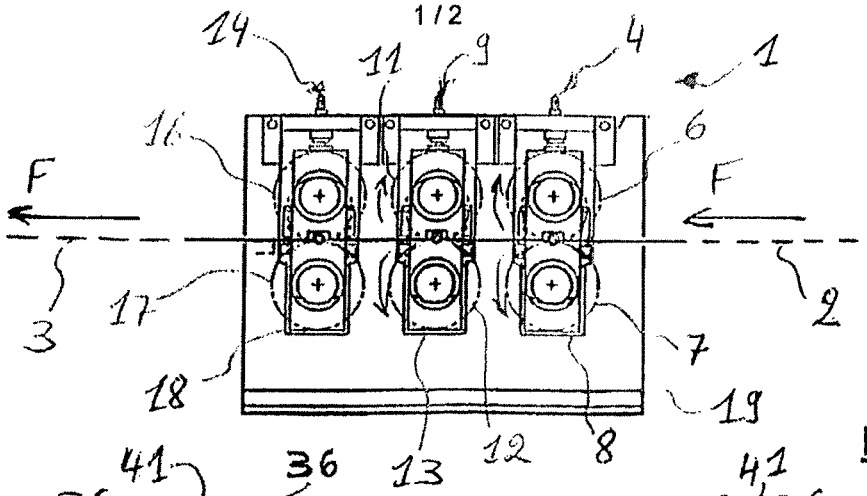
FIG. 1 shows a schematic side view of a converting unit.

A machine for producing packaging (not shown) processes a material or a flat substrate which, in this case, is a substrate in the form of a continuous web, for example of flat cardboard. As shown in FIG. 1, the machine comprises a substrate converting unit 1 for converting the web 2. The direction of feed or of unwinding (Arrow F in FIG. 1) of the web 2 and of the converted web following the longitudinal direction indicates the upstream direction and the downstream direction of the unit 1. The positions front and rear are defined with regard to the cross direction, as being the driver or operator side and the side opposite the driver or operator side respectively.

The machine can have a web unwinder, units such as printer groups, means for controlling the quality and the register of the print, a web guiding means and other units which are positioned upstream of the unit 1.

The converting unit 1 is configured for separately embossing, creasing and cutting. The web 2 arrives in the unit 1 through the upstream transverse side thereof, at a constant speed. An introducing group comprising drive rollers and return rollers for the web 2 is provided at the input to the unit 1. The unit 1 converts the web 2, gradually by embossing it, creasing it and cutting it.

The unit 1 delivers repeats or converted boxes 3, which are embossed, creased and cut flat cardboard. The boxes 3 leave the unit 1 through the downstream transverse side thereof, at the same constant speed. The boxes 3, prepared in the unit 1, are then separated laterally and longitudinally from one another in a separating station and then are received in a receiving station (not shown).

The unit 1 comprises a first arrangement configured for providing the embossing 4, and arranged upstream, i.e. at the input, to said unit 1. The embossing arrangement 4 is provided with a top rotary embossing tool 6, positioned parallel to a bottom rotary embossing tool 7. In this exemplary embodiment, an embossing cassette 8 comprises the embossing arrangement 4.

The unit 1 comprises a second arrangement configured for providing the creasing 9, and disposed downstream of the embossing arrangement 4. The creasing arrangement 9 is provided with a top rotary creasing tool 11, positioned parallel to a bottom rotary creasing tool 12. In this exemplary embodiment, a creasing cassette 13 comprises the creasing arrangement 9.

The unit 1 also comprises a third arrangement configured for providing the cutting 14, and disposed downstream of the creasing arrangement 9, i.e. at the output of the unit 1. The cutting arrangement 14 is provided with a top rotary cutting tool 16, positioned parallel to a bottom rotary cutting tool 17 wherein the tool 17 is e.g. in the form of a smooth unit for the cutting elements on the top cutting tool. In this exemplary embodiment, a cutting cassette 18 comprises the cutting arrangement 14.

The arrangements 4, 9 and 14, and thus the cassettes 8, 13 and 18, are placed following one another so that each one realizes its respective conversion, by embossing, creasing and cutting the web 2. A waste ejecting tool in the form of a cylinder provided with ejecting spindles can also be provided in place of the bottom rotary cutting tool 17. Other combinations are possible such as a top cylinder forming both a cutting tool and a creasing tool.

Figure 2:
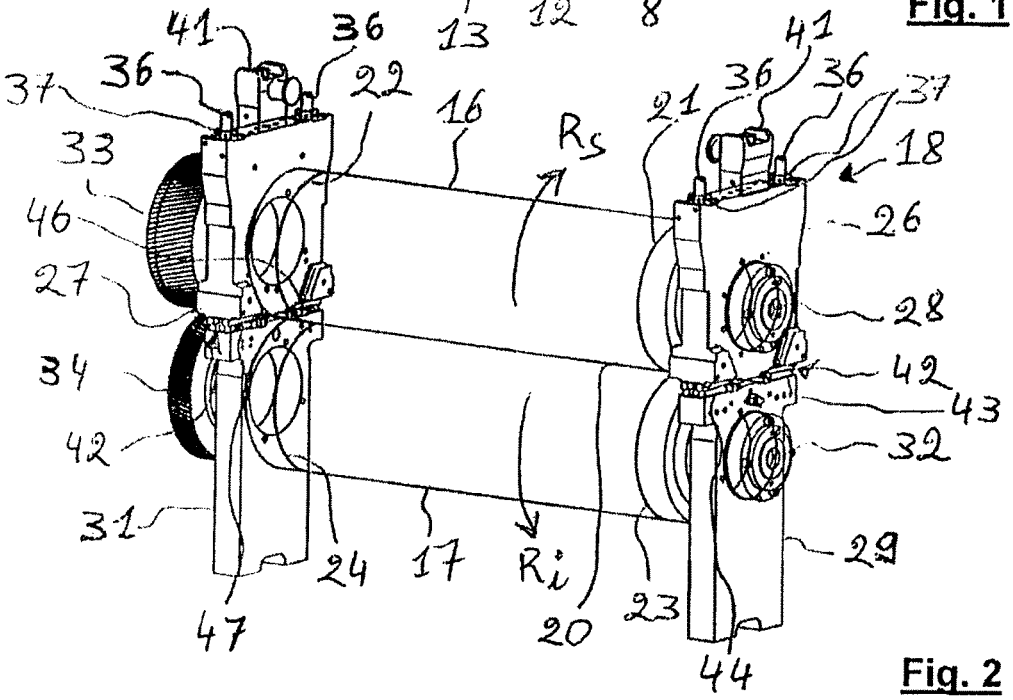
FIG. 2 shows an isometric view of a cassette provided with a converting arrangement according to the invention.

The rotational axis of each of the tools for embossing 6 and 7, creasing 11 and 12 and cutting 16 and 17 is oriented transversely with respect to the unwinding direction F of the web 2. The rotational direction (Arrow Rs in FIG. 2) of the top tools for embossing 6, creasing 11 and cutting 16 is reversed with respect to the rotational direction (Arrow Ri in FIG. 2) of the bottom tools for embossing 7, creasing 12 and cutting 17.

The cassettes for embossing 8, creasing 13 and cutting 18 are configured for being introduced into a supporting structure 19 of the unit 1, for being attached to the supporting structure 19, for producing, and then conversely, are configured for losing the positive connection with the supporting structure 19 and of being extracted from the supporting structure 19. The unit 1 thus comprises three transverse housings provided in the supporting structure 19 for each of the three cassettes 8, 13 and 18. The cassettes 8, 13 and 18 are introduced vertically, from above with respect to the supporting structure 19 and into the transverse housings. Conversely, the cassettes 8, 13 and 18 can be removed vertically with respect to the supporting structure 19, out of their respective transversal housing.

The cutting arrangement 14, and therefore the cutting cassette 18, comprises (see FIG. 2) the top cylindrical rotary tool 16 which is provided with cutter threads (not shown) machined or built on its circumference in terms of the configuration of the boxes to be realized. The bottom cylindrical rotary tool or anvil 17 has a smooth circumference. The web 2 unwinds in direction F in the radial gap 20 between the top tool 16 and the anvil 17. The top tool 16 is arranged so as to cooperate with the anvil 17 in order to convert, i.e. cut the web 2.

The top tool 16 is provided at each of its opposite ends with a bearing ring 21 or 22, respectively. The anvil 17 is provided at each of its opposite ends with a bearing ring 23 or 24 respectively. The bearing rings 21 and 22 at the ends of the top tool 17 contact, bear on and roll on the respective opposite bearing rings 23 and 24 at the ends of the anvil 17.

The cutting arrangement 14, and therefore the cutting cassette 18, comprises a first top front bearing 26 and a second top rear bearing 27 at the ends of the top tool, which hold the first tool, here the top tool 16, by its rotational axis 28 for rotation. The cutting arrangement 14, and therefore the cutting cassette 18, comprises a third bottom front bearing 29 and a fourth bottom rear bearing 31 at the ends of the second bottom tool which hold the second tool, here the anvil 17, by its rotational axis 32 for rotation. The base of the two bottom bearings 29 and 31 rests on the supporting structure 19 when the cutting cassette 18 is inserted into the unit 1.

The cutting arrangement 14, and therefore the cutting cassette 18, comprises driving means which drive the two tools 16 and 17 in a rotating manner. The driving means are formed with a first top gear wheel 33 for the top tool 16 attached at the rear on its axis of rotation 28. The first gear wheel 33 meshes with a second bottom gear wheel 34 for the anvil 17 which is attached at the rear on its axis of rotation 32. When the cassette 18 is inserted into the supporting structure 19, the teeth of the first gear wheel 33 mesh with the teeth of a gear wheel combined with an electric motor for rotational movement.

The first top front bearing 26 of the top tool 16 is attached to the third bottom front bearing 29 of the anvil 17, and the second top rear bearing 27 of the top tool 16 is attached to the fourth bottom rear bearing 31 of the anvil 17, so as to constitute the cutting cassette 18. To hold the cassette 18 in one single unit, elements, in the form of four ties 36, front upstream, front downstream, rear upstream and rear downstream, extend in a vertical manner and are arrayed across the top front bearing 26 and the top rear bearing 27 respectively, and on both sides of the rotational axis 28 of the top tool 16. The bottom end of each of the four ties, front and rear 36, is threaded and that thread is screwed into a thread of the bottom front bearing 29 and of the bottom rear bearing 31 respectively. Four nuts 37, front upstream, front downstream, rear upstream and rear downstream, are screwed onto the top end of the four ties 36 respectively. The nuts 37 block the ties 36 by bearing on a top face of the top front bearing 26 and of the top rear bearing 27 respectively and allowing the bearings and the ties to be prestressed.

The cutting cassette 18, as well as the cassettes for embossing 8 and creasing 13, comprises two gripping lugs 41 each provided on the top face of the top front bearing 26 and of the top rear bearing 27. The two lugs 41 are intended for cooperating with lifting means (not shown) to lift and transport the cassette 8, 13 and 18.

So as to provide a satisfactory functioning of the cutting cassette 18 or of the rotary cutting arrangement 14, it is advisable to carry out a minute adjustment of the gap existing between the top tool 16 and the anvil 17. To do this, adjustment means 42 are inserted between the first top front bearing 26 and the third bottom front bearing 29 and between the second top rear bearing 27 and the fourth bottom rear bearing 31.

The adjustment means 42 comprise spacers, in this case analogous to wedges, which are mobile by sliding. Four spacers 43, 44, 46 and 47 are provided according to the invention. A front upstream spacer 43, a front downstream spacer 44, a rear upstream spacer 46 (can be seen showing through in FIG. 2) and a rear downstream spacer 47 allow for four different adjustments, front and rear, upstream and downstream.

By displacing the spacers 43, 44, 46 and 47 laterally along their respective tools, a gap e (see FIG. 4) varies, upstream and downstream, between the first bearing 26 and the third front bearing 29 and between the second bearing 27 and the fourth rear bearing 31. The gap e is obtained as a result of a top inclined face 48 (visible on FIGS. 4-6 with angle α of the inclined face) of the spacer 43. Horizontalness adjustments in the longitudinal direction and in the cross direction are possible using the four spacers 43, 44, 46, and 47.

Figure 4:
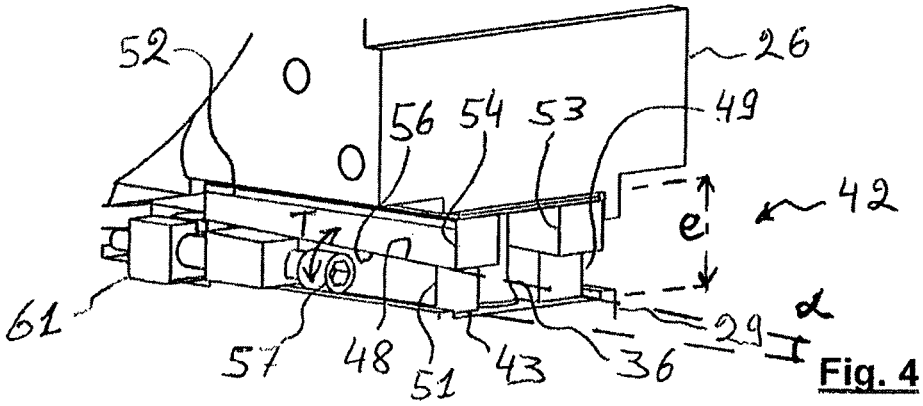
FIG. 4 shows an isometric part view of the adjusting means.
Figure 3:
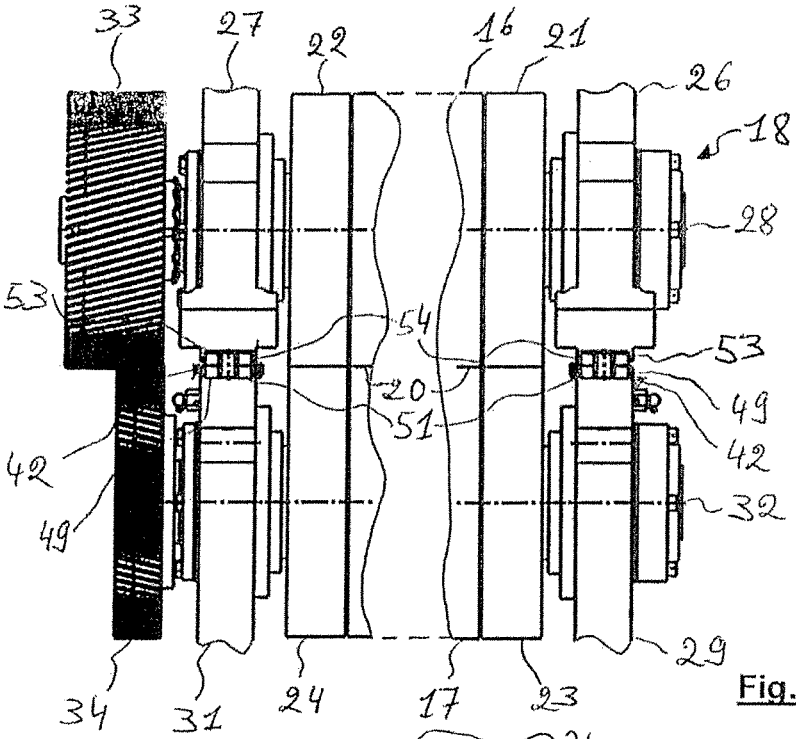
FIG. 3 shows a part side view of the cassette of FIG. 2.

As is shown in FIGS. 3 and 4, the spacer 43 is in the form of a metallic chock with two legs 49 and 51, leaving a space in order to be enable pass through of the corresponding tie 36. The two legs 49 and 51 of the spacer 43 are laid flat against the top face of the bottom front bearing 29. The two legs 49 and 51 have a top inclined face 48.

An insert part 52, also with two legs 53 and 54, is favorably locked to the bottom face of the first top bearing 26 or to the second top bearing 27. The two legs 53 and 54 of the insert part 52 comprise an opposite bottom inclined face 56, corresponding to the top inclined face 48 of the spacer 43.

Figure 5:
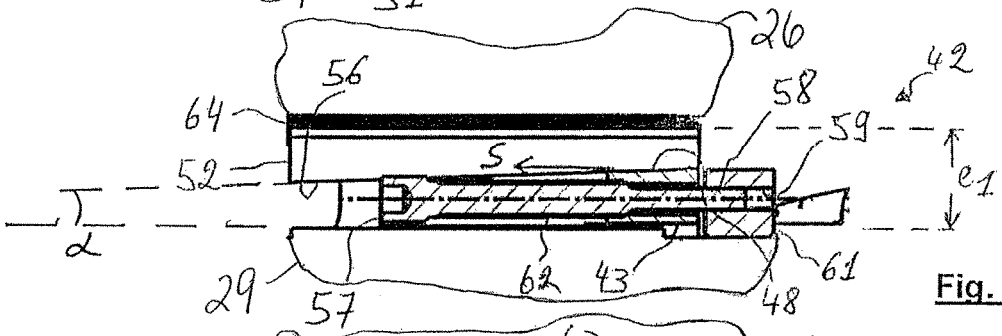
FIGS. 5 and 6 show a part longitudinal sectional view of the adjustment means with a first and a second gap respectively.
Figure 6:
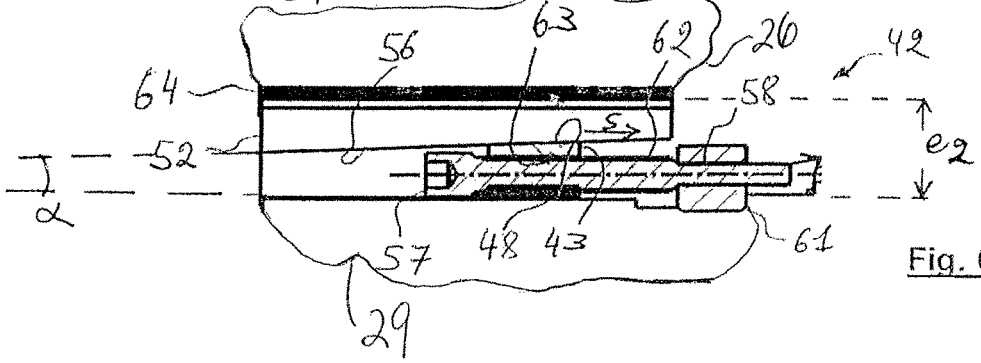

The sliding (Arrow S in FIGS. 5 and 6) of the spacer 43 between the third bottom bearing 29 or the fourth bottom bearing 31 and the insert part 52 allows the gap e to be adjusted, the top inclined face 48 being laid flat against the opposite bottom inclined face 56 with different possible positions (see FIGS. 5 and 6). The sliding S is along the longitudinal directions transverse to the length direction of the tools between the bearings at the ends of the tools.

The action to adjust the gap e is defined as being the action to fill in the gap e between the bearings 26, 27, 29 and 31, in the case of the cutting tools 16 and 17. After adjustment by the spacers, the adjustment of the precise gap 20 is obtained by the bearing rings 21, 22, 23 and 24. The action to adjust the gap e is defined as being the action to control the gap e of the precise gap 20 in the case of the tools for embossing 6 and 7 and for creasing 11 and 12.

In FIG. 5, the spacer 43 is at the bottom compared to the insert part 52, and, as a result, the gap e1 is the smallest. In FIG. 6, the spacer 43 is advanced compared to the insert part 52, and, as a result, the gap e2 is greater, in excess of the smallest gap e1.

According to the invention, the spacer 43 is displaced by sliding S thanks to a screw 57. The screw 57 is advantageously a differential screw which has a first outer thread 58 which cooperates with a first inner thread 59 of a part 61 which is joined with the bottom bearing 29. The screw 57 connects the sliding spacer 43 mechanically to the immobile part 61. The screw 57 has a second outer thread 62 which cooperates with a second inner thread 63 which is arranged in the mobile spacer 43. The two threads 58 and 62, and their corresponding thread 59 and 63, allow the gap e to be finely adjusted, in terms of the difference in the chosen pitch. The difference in pitch corresponds to the sensitivity desired for the adjustment. The screw 57 has a different diameter at the two threads 58 and 62. The second thread 62 has a larger diameter than the first thread 58. When the screw 57 is turned (Arrow T in FIG. 4) and progresses in a direction, the spacer 43 progresses S in the same direction.

The spacers 43, 44, 46, and 47 and the insert part 52 have an elongated form. The inclined face 48 of all the spacers 43, 44, 46 and 47, and consequently the inclined face 56 of the insert part 52, is preferably oriented along the longitudinal direction. In other words, the long length of the spacers 43, 44, 46 and 47 and of the insert part 52 is parallel to the longitudinal direction. Access to the screw 57 is upstream and downstream of the arrangement 14 and/or of the cassette 18, which proves more ergonomic for the operator.

In an advantageous manner, the cutting arrangement 14 further comprises a plane chock with a predefined thickness 64, inserted between the first top bearing 26 or the second top bearing 27 and the insert part 52 with the inclined face 56. The plane chock 64 allows for adaptation when using cylinders 16 and 17 with different diameters.

With a more ergonomical converting unit 1, the risk of errors is strongly reduced, which, as a consequence, brings about a reduction in non-standard boxes or in boxes not having an optimum quality.

The present invention is not limited to the embodiments described and illustrated. Numerous modifications can be realized without in any way departing from the framework defined by the scope of the set of claims.

The invention claimed is:

1. A converting arrangement for a flat substrate, said converting arrangement comprising:

a first cylindrical, rotary, converting tool and a second, cylindrical, rotary, converting tool, the first tool cooperating with the second tool to convert the substrate;

a first lateral bearing and a second lateral bearing, each of the first lateral bearing and the second lateral bearing being located toward a respective end of the first tool and holding the first tool for rotation;

a third lateral bearing and a fourth lateral bearing, each of the third lateral bearing and the fourth lateral bearing being located toward a respective end of the second tool and holding the second tool for rotation; and horizontal adjustment spacers each having an inclined face and each horizontal adjustment spacer being horizontally and vertically slidable along an inclined face thereof, without rotation of the horizontal adjustment spacer, to adjust vertically each respective gap between the first lateral bearing and the third lateral bearing and between the second lateral bearing and the fourth lateral bearing to adjust a radial gap between the first tool and the second tool; wherein the horizontal adjustment spacers comprise two of the horizontal adjustment spacers which are inserted between the first lateral bearing and the third lateral bearing and two of the horizontal adjustment spacers which are inserted between the second lateral bearing and the fourth lateral bearing.

2. The converting arrangement according to claim 1, further comprising a horizontal differential screw, wherein at least one of the horizontal adjustment spacers is displaceable by the horizontal differential screw, the horizontal differential screw having a first thread which cooperates with a third thread of a part of the arrangement which is joined with one of the lateral bearings, and the horizontal differential screw having a second thread which is distinct from the first thread and which cooperates with a fourth thread of the horizontal adjustment spacer, the horizontal differential screw not being included in a component of the converting arrangement which includes the horizontal adjustment spacer.

3. The converting arrangement according to claim 1, wherein the inclined face of the horizontal adjustment spacer is oriented in a longitudinal direction of the arrangement, transversely to a direction of rotational axes of the first tool and the second tool and between the lateral bearings at the ends of the first tool and the second tool.

4. The converting arrangement according to claim 3, wherein the horizontal adjustment spacer slides respectively between the third lateral bearing or the fourth lateral bearing and a part with an inclined face which is locked to the first lateral bearing or to the second lateral bearing.

5. The converting arrangement according to claim 4, further comprising a plane chock having a predefined thickness inserted between the first lateral bearing and the part with the inclined face or between the second lateral bearing and the part with the inclined face.

6. The converting arrangement according to claim 1, wherein the first tool and the second tool together are at least one of a cutting tool, an embossing tool, a creasing tool and a waste ejecting tool.

7. A converting cassette for a flat substrate wherein said converting cassette comprises a converting arrangement according to claim 1.

8. A converting unit for a flat substrate, further comprising said converting unit includes at least one converting cassette according to claim 7.

9. A converting unit for a flat substrate, wherein said converting unit comprises at least one converting arrangement according to claim 1.

10. A machine for producing packaging from a flat substrate, said machine comprising a converting unit according to claim 9.

11. A converting arrangement for a flat substrate, said converting arrangement comprising:

a first cylindrical, rotary, converting tool and a second, cylindrical, rotary, converting tool, the first tool cooperating with the second tool to convert the substrate;

a first lateral bearing and a second lateral bearing, each of the first lateral bearing and the second lateral bearing being located toward a respective end of the first tool and holding the first tool for rotation;

a third lateral bearing and a fourth lateral bearing, each of the third lateral bearing and the fourth lateral bearing being located toward a respective end of the second tool and holding the second tool for rotation;

horizontal adjustment spacers, each having an inclined face and each horizontal adjustment spacer being horizontally and vertically slidable along an inclined face thereof, without rotation of the horizontal adjustment spacer, to adjust vertically each respective gap between the first lateral bearing and the third lateral bearing and between the second lateral bearing and the fourth lateral bearing to adjust a radial gap between the first tool and the second tool; and a horizontal differential screw, wherein at least one of the horizontal adjustment spacers is horizontally displaceable by the horizontal differential screw, the horizontal differential screw having a first thread which cooperates with a third thread of a part of the arrangement which is joined with one of the lateral bearings, and the horizontal differential screw having a second thread, which is distinct from the first thread, and which cooperates with a fourth thread of the horizontal adjustment spacer, the horizontal differential screw not being included in a component of the converting arrangement which includes the horizontal adjustment spacer.

12. The converting arrangement according to claim 11, wherein the horizontal adjustment spacers comprise two of the horizontal adjustment spacers inserted between the first lateral bearing and the third lateral bearing, and two of the horizontal adjustment spacers inserted between the second lateral bearing and the fourth lateral bearing.

13. The converting arrangement according to claim 11, wherein the first and the second threads of the horizontal differential screw have respective different pitches.

* * * * *